US005470454A

United States Patent [19]

Grandvallet et al.

[11] Patent Number: 5,470,454

[45] Date of Patent: Nov. 28, 1995

[54] PROCESS FOR THE PREPARATION OF LUBRICATING BASE OILS

[75] Inventors: Pierre Grandvallet; Daniel G. P. Allais; Pierre E. J. G. Dejaifve, all of Grand Couronne, France

[73] Assignee: Shell Oil Company, Houston, Tex.

[21] Appl. No.: 71,434

[22] Filed: Jun. 2, 1993

[30] Foreign Application Priority Data

Jul. 17, 1992 [EP] European Pat. Off. ..... 92402069

[51] Int. Cl.[6] ..... C10G 45/00; C10G 71/00

[52] U.S. Cl. ..... 208/144; 208/143; 208/89

[58] Field of Search ..... 208/18, 58, 87, 208/89, 143, 144, 145, 19; 204/168; 292/51.5 A, 32.7 E; 585/517

[56] References Cited

U.S. PATENT DOCUMENTS 4,325,804 4/1982 Everett et al. ..... 208/58

4,764,265 8/1988 Bijwaard et al. ..... 208/18

5,034,108 7/1993 Dufour et al. ..... 204/168

FOREIGN PATENT DOCUMENTS 346999 12/1989 European Pat. Off. .

*Primary Examiner*—Anthony McFarlane

*Assistant Examiner*—Bekir L. Yildirim

[57] ABSTRACT

A process for the preparation of a lubricating base oil, comprising treating a hydrocarbonaceous product with hydrogen, at elevated temperature and pressure and in the presence of a catalyst, which hydrocarbonaceous product has been prepared by contacting hydrocarbons and/or derivatives thereof with an active hydrogen-containing system by a process which comprises generating a hydrogen-containing plasma and allowing contact of the hydrocarbons and/or derivatives thereof in liquid form with the plasma-generated system and recovering the hydrocarbonaceous product.

18 Claims, 1 Drawing Sheet

PROCESS FOR THE PREPARATION OF LUBRICATING BASE OILS

FIELD OF THE INVENTION

The present invention relates to a process for the preparation of a lubricating base oil based on a hydrocarbonaceous product prepared by contacting hydrocarbons and/or derivatives thereof with an active hydrogen-containing system.

BACKGROUND OF THE INVENTION

European Patent Application Publication No. 346999 (EP 346999) discloses a process for the preparation of a lubricating base oil, containing a hydrocarbonaceous product prepared by contacting hydrocarbons and/or derivatives thereof with an active hydrogen-containing system, which process includes generating a hydrogen-containing plasma at a pressure of at least 0.007 bar and allowing contact of the hydrocarbons and/or derivatives thereof in liquid form with the plasma-generated system and recovering the hydrocarbonaceous product.

For the purpose of this specification, a process such as disclosed in EP 346999 will hereinafter be referred to as a plasma-process. The disclosure of EP 346999 is hereby incorporated by reference. It will be understood that the hydrocarbonaceous product referred to throughout the specification is the product of plasma-process. Derivatives as referred to in this specification are defined as hydrocarbons containing heteroatoms, such as sulphur, nitrogen and/or oxygen.

It has now been found that certain lubricating base oil properties of the aforementioned hydrocarbonaceous product, such as dispersancy, cleanliness and/or oxidation stability, can be further and significantly improved by treating the hydrocarbonaceous product with hydrogen at elevated temperature and pressure in the presence of a catalyst.

Moreover, it has been found that in the process of the present invention, other advantageous lubricating base oil properties of the hydrocarbonaceous product, such as a high viscosity, a high viscosity index (VI) and a low pour point remain substantially unchanged or are even slightly improved.

SUMMARY OF THE INVENTION

The present invention therefore relates to a process for the preparation of a lubricating base oil, including treating a hydrocarbonaceous product with hydrogen, at elevated temperature and pressure and in the presence of a catalyst, which hydrocarbonaceous product has been prepared by contacting hydrocarbons and/or derivatives thereof with an active hydrogen-containing system by a process which includes generating a hydrogen-containing plasma and allowing contact of the hydrocarbons and/or derivatives thereof in liquid form with the plasma-generated system and recovering the hydrocarbonaceous product.

BRIEF DESCRIPTION OF THE DRAWING

Reference is made to the attached drawing, which in a single figure depicts in the form of a simple flow diagram an embodiment of the process according to the present invention.

In the process depicted, a hydrocarbonaceous feedstock is introduced in liquid form into contact with activated hydrogen-plasma, the resulting mixture is separated into oil and gas components, the oil phase is in part recycled to hydrogen-plasma contact, and the remainder of the oil phase is treated for hydrogenation to provide a lubricating base oil.

DESCRIPTION OF THE PREFERRED EMBODIMENTS OF THE INVENTION

Figure 1:
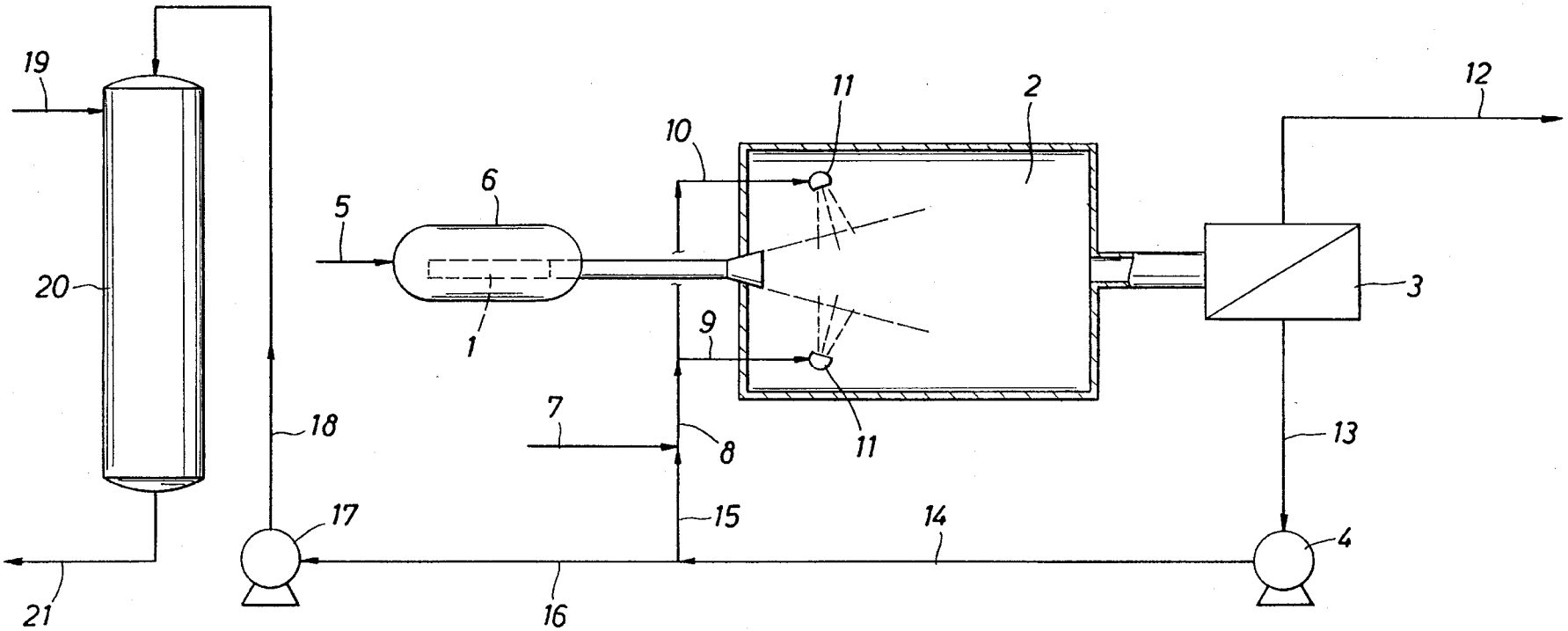

The treatment of the hydrocarbonaceous product is carried out under conditions such that cracking reactions are prevented as much as possible. Typically, the treatment conditions are chosen in such a way that hydrogenation reactions clearly prevail over other reactions, such as hydrocracking and hydroisomerizing reactions.

It has been found that when the hydrocarbonaceous product contains functional groups, that is substituents containing one or more heteroatoms, it is possible to select the treatment conditions in such a way that the functional groups remain substantially unchanged after treatment.

Preferably, the hydrocarbonaceous product is treated at a temperature of from about 20° C. to 450° C., more preferably the hydrocarbonaceous product is treated at a temperature of from about 150° C. to about 300° C. The hydrocarbonaceous product may be treated under a relatively wide range of pressures. Preferably, the hydrocarbonaceous product is treated at a hydrogen partial pressure of from about 1 bar abs. to about 200 bar abs., more preferably at a hydrogen partial pressure of from about 40 bar abs. to about 140 bar abs. Preferably, the hydrocarbonaceous product is provided at a space velocity of from 0.1 kg/l/h to 4.0 kg/l/h, more preferably at a space velocity of from 0.2 kg/l/h to 2.0 kg/l/h. The ratio of hydrogen to the hydrocarbonaceous product may range from 100 Nl/kg to 5000 Nl/kg and is preferably from 250 Nl/kg to 2500 Nl/kg.

The hydrocarbonaceous product may be treated with pure hydrogen gas or with a gaseous mixture including hydrogen gas together with one or more gases which are substantially inert under the prevailing reaction conditions. Examples of suitable gaseous mixtures include hydrogen/nitrogen mixtures and hydrogen gas containing traces of gaseous hydrocarbons, such as refinery-derived hydrogen gas. The amount of hydrogen in the gaseous mixture is not critical and a wide range of hydrogen concentrations may be employed. However, in order to reduce the amount of gas to be used in the present process, it is preferred to treat the hydrocarbonaceous product with a gaseous mixture including at least 75 mole % of hydrogen gas, more preferably at least 85 mole % of hydrogen gas.

The treatment (hydrogenation) of the hydrocarbonaceous product may be carried out using any of the catalyst bed arrangements known in the art, such as a fluidized bed, moving bed, slurry phase bed or a fixed bed. Preferably, a fixed catalyst bed is applied. It is to be understood that the reaction conditions, such as temperature, pressure and space velocity, may vary within the ranges specified hereabove according to the specific type of catalyst bed being used.

Any suitable hydrogenation catalyst may be used in the process of the present invention. Typically, the catalyst contains a catalytically active metal, selected from Group VIII and/or Vib of the Periodic Table of the Elements. Preferably, the catalyst contains a catalytically active metal selected from the group containing cobalt, nickel, iron, platinum, palladium, molybdenum and tungsten. More preferably, the catalyst contains cobalt and/or nickel and, optionally, molybdenum and/or tungsten. Typically, the catalyst further contains a refractory oxide carrier, preferably a carrier containing silica, silica-alumina or alumina.

The hydrocarbonaceous product to be treated may be any oil having lubricating properties, which oil is prepared by treatment of hydrocarbon(s) and/or derivatives thereof with an active hydrogen-containing system (a plasma-process) as described hereinbefore. In a preferred embodiment of the invention, the hydrocarbonaceous product contains a plasma-produced, extra high viscosity index lubricating base oil, that is, having a VI above 140. More preferably, the hydrocarbonaceous product also includes one or more functional groups, in particular, functional groups derivable from carboxylic groups, ester groups, amino and/or amido groups, preferably a polyamine such as tetraethylene pentamine.

The process for the preparation of the hydrocarbonaceous product to be treated in the process of the present invention can be carried out by using as starting material any hydrocarbon and/or derivative thereof which is liquid or solid under conditions of standard temperature and pressure. The effect of such process is usually, and preferably, to increase the molecular weight of the starting material.

In order to account for the possibility that a minor amount of the feedstock to be treated in the plasma-process might undergo a (temporarily) molecular weight decrease which would offset the substantial molecular weight increase generally contemplated by the process, the expression "average molecular weight" will be used throughout the specification indicating an overall increase in molecular weight.

Preference is given to the use of hydrocarbons ranging from the kerosene range to the heaviest grades of lubricating base oils as starting materials for the hydrocarbonaceous product. In particular the process for the preparation of the hydrocarbonaceous product is usually, and preferably, carried out in order to increase the molecular weight (and therefore the viscosity and optionally the VI) of extra high viscosity index lubricating base oils, i.e., base oils already having a VI of at least 140, such as those base oils sold under the trademark "XHVI". Various refinery feedstocks such as hydrocracker bottoms and gas oils, as well as various kinds of cycle oils, may be used as starting materials for the process. In addition, blends of various hydrocarbon feedstocks, e.g., various base oil compositions, may be used.

has been found that the process for the preparation of the hydrocarbonaceous product can be carried out in a controllable manner, that is, the molecular weight of the starting material can be increased by a factor of, for example, 10–300%, without suffering from such disadvantages as cracking or coke formation.

If desired, and often preferred, the starting materials for the process for the preparation of the hydrocarbonaceous product may contain functional groups. Examples of functional groups which may be present in the hydrocarbons to be treated in accordance with the process for the preparation of the hydrocarbonaceous product, containing carboxylic groups, ester groups, amino and/or amido groups. Typical examples of compounds carrying functional groups include carboxylic acids and carboxylic acid esters such as stearic acid, lioleic acid, oleic acid and the alkyl esters, in particular the methyl and ethyl esters thereof. If desired, the hydrocarbon derivatives used as starting materials may contain two or more functional groups like the higher amino carboxylic acids and the corresponding esters. It will be appreciated that when mixtures containing both hydrocarbon(s) and hydrocarbon derivatives containing one or more functional groups are used as starting materials for the process for the preparation of the hydrocarbonaceous product, not only the molecular weight of the starting materials will be increased, but that functional groups may also be incorporated into said hydrocarbon(s).

It should be noted that also unsaturated compounds may be used together with the hydrocarbon(s) and/or derivatives as starting materials for preparing the hydrocarbonaceous product. Even under such circumstances the process can be carried out in a controllable mode.

An especially preferred hydrocarbonaceous product is one prepared from a lubricating base oil, preferably an extra high viscosity index lubricating base oil, such as "XHVI", and a polyamine as starting materials in the plasma-process as described above. Examples of preferred polyamines include diethylene triamine, triethylene tetramine, tetraethylene pentamine, pentaethylene hexamine or 4-amino diphenylamine. The hydrocarbonaceous product recovered includes base oil and polyamine molecules linked to each other. The hydrocarbonaceous product may be treated with hydrogen at elevated temperature and pressure, in the presence of a catalyst, to yield a functionalized lubricating base oil in accordance with the present invention.

It is preferred in the process for the preparation of the hydrocarbonaceous product that the hydrocarbon(s) and/or derivatives thereof used as starting materials are contacted in liquid form with an active hydrogen-containing system which is obtained by generating a hydrogen-containing plasma. A plasma is defined for the purpose of this specification as a gaseous medium containing electrical charges which as a whole are at electric neutrality. It will be clear that a hydrogen-containing plasma therefore does not only consists of hydrogen atoms and hydrogen molecules (e.g., obtained by pure thermal dissociation ), $H_2$-ions as well as electrons should also be present, provided the electric neutrality is preserved.

Molecular hydrogen is of course a suitable source to produce a hydrogen-containing plasma, but other hydrogen-containing species such as ammonia, hydrogen sulfide, methane and/or $H_2O$ may be present if desired to contribute to the generation of the hydrogen-containing plasma. In general, the hydrogen source should contain no less than 75% (on a molar basis) of molecular hydrogen. Conventional refinery hydrogen streams may be applied. In principle, any means for activating hydrogen to the extent that a hydrogen-containing plasma is formed can be used, such as electrode-less discharges and appropriate laser beams.

The hydrogen-containing plasmas to be used in the process for the preparation of the hydrocarbonaceous product are suitably produced by so-called plasma torches, which are well-known as such and used in various branches of industry. Typically, plasma torches having an energy-production in the range of up to 8000 kW may be applied. Preference is given to the use of plasma torches having an energy-production in the range of from 500 to 3000 kW.

The hydrogen-containing plasma is produced at a hydrogen pressure which may range from as low as 0.007 bar up to several bar. Preference is given to the use of a hydrogen pressure in the range of from 0.01 bar to 2 bar. If desired, inert gases like argon or helium can be present in the hydrogen-containing system. The process for the preparation of the hydrocarbonaceous product may be carried out in a discharge-equipment provided with recycle means in order to increase the overall yield of the process.

An embodiment of the process according to the present invention is depicted in FIG. 1. The apparatus includes a plasma torch 1, an expanding region 2, an oil/gas separating means 3 and a recycle pump 4. Hydrogen is introduced via line 5 into plasma generating device 6.

The plasma generating equipment is operated in such a way that hydrogen is introduced at about 1 bar and has a temperature of about 4500K when leaving the torch. It is important in the apparatus operating under these conditions of temperature and pressure to allow for expansion of the hydrogen-plasma created.

It has been found that the plasma should be allowed to expand to allow an optimal contact between the species generated in the plasma (but not necessarily having the initial composition of the plasma) and the hydrocarbons and/or derivatives to be treated. Typically, the pressure at the end of the torch is relieved to pressures in the range from 0.1 to 100 mbar.

Normally the feedstock to be treated is introduced via line 7 and sent via lines 8, 9 and 10 to openings 11 in the expansion region 2 to allow introduction of the feedstock to be treated in liquid form downstream of the generated activated hydrogen-plasma. It will be clear that more inlet openings are possible; the number and design of openings are preferably chosen to optimize the surface area of the feedstock. After the contact between the oil to be treated and the plasma-generated system has taken place inside region 2 the mixture obtained is sent to oil/gas separation chamber 3 allowing for the gaseous part (consisting mainly of unchanged and recombined hydrogen) to be sent to compression in order to be introduced again into the system via line 12 which is linked (not shown) with line 5. The oil phase is sent via line 13 to recycle pump 4 to bring it at the desired pressure level to be recycled via lines 14 and 15 to line 8 for reintroduction within the expanding region. Product can be withdrawn from recycle stream 14 via line 16.

By properly choosing the recycle ratio of the hydrocarbonaceous material processed and by adjusting the surface area of the feedstock to be introduced via openings 11 into expansion region 2, the oligomerization and/or functionalization reactions can be controlled.

The hydrocarbonaceous product withdrawn via line 16 is sent to hydrogenation reactor 20, via pump 17 and line 18. Hydrogen is provided to reactor 20 via line 19.

The lubricating base oil, obtained after hydrogenation, is withdrawn from reactor 20 via line 21.

It is to be understood that FIG. 1 is a simplified scheme of one embodiment of the process according to the present invention. Apparatuses, such as heat exchange means and additional pumps, have been omitted for the sake of clarity, but will be apparent to those skilled in the art. In another embodiment of the invention, the apparatus for preparing the hydrocarbonaceous product can be replaced by an apparatus such as depicted in FIG. 1 of EP 346999. The present invention will now be illustrated by means of the following Examples.

EXAMPLES

Example 1

Preparation of a hydrocarbonaceous product

An XHVI base oil having the properties as expressed in Table I was processed in order to prepare a hydrocarbonaceous product which can be withdrawn from expansion region 2 via line 16 in the equipment as described in FIG. 1. The plasma-process was carried out in the expansion region 2 under the following conditions:

| | |
|---|---|
| total pressure | 0.04 bar |
| energy input | 14 Wh/g |

The results of this experiment are also given in Table I. No cracking was observed and the average molecular weight increase was no less than 46%. The viscosity in cSt (at 100° C.) was raised from 8 to 24.4.

TABLE I

| | XHVI untreated | Hydrocarb. product |
|---|---|---|
| viscosity (100° C.) | 8 cSt | 24.4 cSt |
| viscosity (40° C.) | 46.8 cSt | 211 cSt |
| VI | 143 | 145 |
| Pour Point (°C.) | −16 | −15 |
| Average molecular weight | 578 | 849 |

Example 2

Preparation of a lubricating base oil

The hydrocarbonaceous product of Example 1 was provided to reactor 20 as depicted in FIG. 1, at a space velocity of 1.5 kg/l/h. Hydrogen gas was provided to reactor 20 at a hydrogen/hydrocarbonaceous product ratio of 700 Nl/kg. The reactor was operated under a hydrogen partial pressure of 90 bar and a temperature of 230° C. The reactor contained a fixed catalyst bed, containing a nickel containing catalyst, commercially available from Harshaw and marketed under the name "Ni 0104T". The lubricating base oil thus obtained had the following properties:

| | |
|---|---|
| viscosity (100° C.) | 25.0 cSt |
| viscosity (40° C.) | 217 cSt |
| Viscosity Index | 145 |
| Pour Point | −15° C. |
| Average Molecular Weight | 849 |

Example 3

Preparation of a hydrocarbonaceous product

The process as described in Example 1 was repeated but now in the presence of 10% by weight of tetraethylene pentamine (TEPA). The hydrocarbonaceous product contained 0.41% by weight nitrogen. The results of this experiment are given in Table II. No cracking was observed and the viscosity in cSt (at 100° C.) was raised from 8 to 22.0.

TABLE II

| | XHVI untreated | Hydrocarb. product |
|---|---|---|
| viscosity (100° C.) | 8 cSt | 22.0 cSt |
| viscosity (40° C.) | 46.8 cSt | 180 cSt |
| VI | 143 | 150 |
| Pour Point (°C.) | −15 | −15 |
| Average molecular weight | 578 | — |
| Nitrogen content (% wt.) | — | 0.41 |

Example 4

Preparation of a lubricating base oil

The hydrocarbonaceous product of Example 3 was provided to reactor 20 as depicted in FIG. 1, at a space velocity of 0.4 kg/l/h. Hydrogen gas was provided to reactor 20 at a hydrogen/hydrocarbonaceous product ratio of 1000 Nl/kg. The reactor was operated under a hydrogen partial pressure of 80 bar and a temperature of 200° C. The reactor contained a fixed catalyst bed, containing a cobalt containing catalyst, commercially available from Girdler and marketed under the name "G-67RS". The lubricating base oil thus obtained had the following properties:

| | |
|---|---|
| viscosity (100° C.) | 20.2 cSt |
| viscosity (40° C.) | 165 cSt |
| Viscosity Index | 142 |
| Pour Point | −15° C. |

Substantially no cracking occurred during the hydrogenation treatment and the functional polyamine groups remained attached to the base oil molecules.

Example 5

Tests

The hydrocarbonaceous products and lubricating base oils of the above Examples were subjected to the following tests:

1. Carbon Black Dispersancy Test (CBDT) (British Rail publication BR 669:1984)

3% of carbon black is added to the oil and increase in kinematic viscosity at 60° C. is determined, using an Ubbelohde viscometer. A low result indicates good performance.

2. Blotter Spot Test (BST Merit)

A drop of a mixture of 5% of an aged oil, containing ashes, and 95% of the tested oil is applied to chromatography paper. When the total spot diameter is 32 mm, the ratio (* 100) of the diameter of the black ashes-containing spot and the diameter of the total spot is measured. A high result indicates good performance.

3. Differential Scanning Calorimetry Test—Induction Period (DSC-IP)

The time elapsing (minutes) before onset of oxidation at 210° C. and an oxygen pressure of 1 atm., of a sample (4 mg) is measured, containing 1.0% wt. of a phenolic antioxidant. A high result indicates good performance.

Results of the above tests are given in Table III following.

TABLE III

| | Sample Exp. 1 | Sample Exp. 2 | Sample Exp. 3 | Sample Exp. 4 |
|---|---|---|---|---|
| Tests: | | | | |
| CBDT | 51 | 51 | 13 | 8 |
| BST Merit | 36 | 36 | 72 | 81 |
| DSC-IP | <10 | 26 | 14 | 21 |

From the above table it can be seen that the process according to the present invention considerably enhances the oxidation stability, as measured in *the DSC-IP test, especially of the hydrocarbonaceous product of Example 1. Further, it can be seen that the process according to the present invention considerably improves the dispersancy properties, of the hydrocarbonaceous product of Example 3, as measured in the CBDT and BST Merit tests.

What is claimed is:

1. A process for the preparation of a lubricating base oil, comprising treating a hydrocarbonaceous product with hydrogen, under hydrogenation conditions at an elevated temperature and pressure and in the presence of a catalyst, which hydrocarbonaceous product has been prepared by contacting hydrocarbons, having a viscosity index of at least 140, and/or derivatives thereof with an active hydrogen-containing system by a process which comprises generating a hydrogen-containing plasma and allowing contact of the hydrocarbons and/or derivatives thereof in liquid form with the plasma-generated system and recovering the hydrocarbonaceous product, and wherein a lubricating base oil having a substantially unchanged viscosity index from said hydrocarbonaceous product is recovered from said treating with hydrogen in the presence of a catalyst.

2. The process according to claim 1, wherein the hydrocarbonaceous product is treated at a temperature of from about 20° C. to about 450° C.

3. The process according to claim 2, wherein the hydrocarbonaceous product is treated at a temperature of from about 150° C. to 300° C.

4. The process according to claim 2, wherein the hydrocarbonaceous product is treated at a hydrogen partial pressure of from about 1 bar absolute to about 200 bar absolute.

5. The process according to claim 4, wherein the hydrocarbonaceous product is treated at a hydrogen partial pressure of from about 40 bar absolute to about 140 bar absolute.

6. The process according to claim 4, wherein the ratio of hydrogen to the hydrocarbonaceous product ranges from about 100 Nl/kg to about 5000 Nl/kg.

7. The process according to claim 6, wherein the hydrocarbonaceous product is provided at a space velocity of from about 0.1 kg/l/h to about 4 kg/l/h.

8. The process according to claim 6, wherein the hydrocarbonaceous product is treated with a gaseous mixture, comprising at least 75 mole % of hydrogen gas.

9. The process according to claim 2, wherein the catalyst comprises a catalytically active metal, selected from Group VIII and/or VIB of the Periodic Table of the Elements.

10. The process according to claim 9, wherein the catalytically active metal is selected from the group comprising cobalt, nickel, platinum, palladium, molybdenum and tungsten.

11. The process according to claim 9, wherein the catalyst comprises cobalt, nickel, molybdenum, or tungsten.

12. The process according to claim 10, wherein the catalyst comprises a refractory oxide carrier.

13. The process according to claim 11, wherein the carrier comprises silica, silica-alumina or alumina.

14. The Process according to claim 8, wherein the hydrocarbonaceous product is a plasma-produced, lubricating base oil comprising functional groups and having a viscosity index of at least 140.

15. The Process according to claim 8, wherein said hydrocarbons are a kerosene grade of lubricating base oil, or a lubricating base oil having a viscosity index of at least 140.

16. The process according to claim 4, wherein said hydrocarbons contain carboxylic groups, ester groups, amino groups, or amido groups.

17. The process according to claim 4, wherein said hydrocarbons consist essentially of a lubricating base oil having a viscosity index of at least 140 and a polyamine selected from diethylene triamine, triethylene tetramine, tetraethylene pentamine, pentaethylene hexamine, or 4-amino diphenylamine.

18. A process for the preparation of a lubricating base oil, comprising treating a hydrocarbonaceous product with hydrogen, at a temperature from about 150° C. to about 300° C. and a hydrogen partial pressure from about 40 bar absolute to about 140 bar absolute, wherein said hydrocarbonaceous product is provided at a space velocity of from 0.2 kg/l/h to about 2 kg/l/h, and in the presence of a catalyst comprising cobalt, nickel, molybdenum, or tungsten, which hydrocarbonaceous product has been prepared by contacting a lubricating base oil comprising functional groups, and having a viscosity index of at least 140, with an active hydrogen-containing system by a process which comprises generating a hydrogen-containing plasma and allowing contact of the hydrocarbons and/or derivatives thereof in liquid form with the plasma-generated system and recovering the hydrocarbonaceous product, and wherein a lubricating base oil having a substantially unchanged viscosity index from said hydrocarbonaceous product is recovered from said treating with hydrogen in the presence of a catalyst.

* * * * *